US007967624B2

(12) United States Patent
Wang et al.

(10) Patent No.: US 7,967,624 B2
(45) Date of Patent: Jun. 28, 2011

(54) CABLE ASSEMBLY ADAPTED TO BE MOUNTED TO PANEL

(75) Inventors: Chang-Yin Wang, Kunshan (CN); Chin-Te Lai, Tu-Cheng (TW); Su-Feng Liu, Kunshan (CN); Li-Bin Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 3 days.

(21) Appl. No.: 12/635,723

(22) Filed: Dec. 11, 2009

(65) Prior Publication Data

US 2010/0151715 A1 Jun. 17, 2010

(30) Foreign Application Priority Data

Dec. 11, 2008 (CN) ..... 2008 1 0306118

(51) Int. Cl.
*H01R 13/64* (2006.01)

(52) U.S. Cl. ..... 439/248

(58) Field of Classification Search ..... 439/248, 439/345, 247, 553, 557, 552, 358, 153, 157; 248/27.3, 222.12, 222.51
See application file for complete search history.

(56) References Cited

U.S. PATENT DOCUMENTS 3,278,145 A * 10/1966 Leshuk ..... 248/27.3
5,741,150 A * 4/1998 Stinson et al. ..... 439/358
5,830,008 A * 11/1998 Broschard, III ..... 439/557
6,752,642 B2 * 6/2004 Ushiro et al. ..... 439/248
6,764,312 B2 * 7/2004 Ushiro et al. ..... 439/33
6,776,637 B2 * 8/2004 Yamada et al. ..... 439/247
6,945,816 B1 * 9/2005 Wu ..... 439/545
7,192,307 B1 * 3/2007 Tran et al. ..... 439/553
7,462,070 B2 * 12/2008 Fukushima ..... 439/607.01
7,575,472 B1 * 8/2009 Wu ..... 439/545
7,651,350 B1 * 1/2010 Wu ..... 439/153

* cited by examiner

*Primary Examiner* — Alexander Gilman

(74) *Attorney, Agent, or Firm* — Wei Te Chung; Andrew C. Cheng; Ming Chieh Chang

(57) ABSTRACT

A cable assembly for mounting to a panel, comprises a housing comprising a mating portion and a retaining portion extending rearward and outward from a rear end of the mating portion, the retaining portion has a receiving hole therein and a cutout communicated with the receiving hole. At least one key is formed on each of an upper surface and a lower surface of the mating portion. A plurality of conductive contacts are disposed in the housing. A positioning member mounted to the retaining portion of the housing defines an inner arm, an outer arm and a connecting portion connecting with the inner arm and the outer arm. The inner arm is disposed in the receiving hole and having a front end extending out of the receiving hole. The outer arm is located on a lateral side of the retaining portion and has a front end extending into the receiving hole via the cutout and is capable of moving the inner arm rearward to make the front end of the inner arm retracted into the receiving hole.

20 Claims, 8 Drawing Sheets

CABLE ASSEMBLY ADAPTED TO BE MOUNTED TO PANEL

FIELD OF THE INVENTION

The present invention generally relates to a cable assembly, and more particularly to a cable assembly adapted to be mounted to a panel of an electronic device.

DESCRIPTION OF PRIOR ART

Cable assemblies are widely used in PC case for signal or power transmission between personal computers and peripheral equipments. Such a cable assembly is usually needed to be mounted to a panel on which a plurality of connectors are arranged side by side to form a sub module.

U.S. Pat. No. 6,776,637 issued to Yamada et al., hereafter "Yamada", discloses an electrical connector mounted to a panel through a fixing pin. As shown in FIGS. 1 to 3 of Yamada, Yamada describes a construction that provides for a connection with a panel opening 26 formed in a panel 24 by directing a connector 10 having a housing 12, including a block 14 for securing cable 22, into the panel opening 26. Protrusions 20 formed in housing 12 correspond to notches 28 formed in the panel opening 26 when the housing 12 is properly aligned with the panel opening 26. Housing 12 is directed (direction B) inside the panel opening 26 until a flange 16 abuts panel 24 such that protrusions 120 have been inserted past the notches 28. Housing 12 is then directed (direction C) such that protrusions 20 are misaligned with notches 28, thereby capturing connector 10 in panel 24. Finally, a fixing pin 30 is directed (direction A) inside through-hole 18 formed in block 14 such that fixing pin 30 is positioned in panel opening 26 to prevent removal of connector 10 from panel opening 126.

To remove the connector 10 from the panel 24, a tool (not shown) is inserted inside of a through-hole 34 and a force is applied in a direction opposite direction A. When sufficient force is applied, notches 32 are directed out of contact with protrusions (not shown) disposed in through-hole 18 that previously engaged notches 32 and secured fixing pin 30 in position with respect to through-hole 18. Upon withdrawal of fixing pin 30 from panel opening 26, connector 10 can be removed by reversing the installation directions.

However, if the connector 10 needs to release from the panel 24, an additional tool is required to engage through-hole 134 to remove fixing pin 130 from the installed position inside panel opening 126. Thus, the process of the connector releasing from the panel 24 is troubled and complicated.

U.S. Pat. No. 6,945,816 issued to Wu on Sep. 20, 2005, hereafter "Wu", discloses a connector assembly adapted to be mounted to a panel. As shown in FIGS. 1 to 7 of Wu, Wu discloses a connector assembly 100 comprising a housing 1 having a number of keys 107, 108 on exterior surfaces thereof and an retaining portion 12, a number of contacts 2 received in the housing 1, and a fixing pusher 6 attached to the retaining portion 12 of the housing 1 along a back-to-front direction. The fixing pusher 6 includes a finger operable main body 60 and a forwardly extending filling bar 61. The keys 107, 108 are adapted to pass through the panel along back-to-front direction and engage with the panel 8 after a movement of the housing relative to the panel 8 along a transversal direction perpendicular to the back-to-front direction. The main body 60 of the fixing pusher 6 is directly pushed by a user to bring the filling bar 61 into engagement with the panel 8, and thus, safely mounts the connector assembly 100 onto the panel 8.

However, when the filling bar 61 is inserted into the panel 8, the main body 60 of the fixing pusher 6 is interlocked with the retaining portion 12 of the housing 1, and thus, the fixing pusher 6 in not easily and conveniently unlocked from retaining portion 12 in result that the connector assembly 100 is not easily and conveniently released from the panel 8.

As discussed above, an improved cable assembly overcoming the shortages of existing technology is needed.

SUMMARY OF THE INVENTION

Accordingly, an object of the present invention is to a cable assembly which can be easily and conveniently mounted to and released from a panel.

In order to achieve the above-mentioned objects, a cable assembly for mounting to a panel, comprises a housing comprising a mating portion and a retaining portion extending rearward and outward from a rear end of the mating portion, the retaining portion has a receiving hole therein and a cutout communicated with the receiving hole. At least one key is formed on each of an upper surface and a lower surface of the mating portion. A plurality of conductive contacts are disposed in the housing. A positioning member mounted to the retaining portion of the housing defines an inner arm, an outer arm and a connecting portion connecting with the inner arm and the outer arm. The inner arm is disposed in the receiving hole and having a front end extending out of the receiving hole. The outer arm is located on a lateral side of the retaining portion and has a front end extending into the receiving hole via the cutout and is capable of moving the inner arm rearward to make the front end of the inner arm retracted into the receiving hole.

Other objects, features and advantages of the invention will be apparent from the following detailed description taken in connection with the accompanying drawings.

DETAILED DESCRIPTION OF PREFERRED EMBODIMENTS

Figure 1:
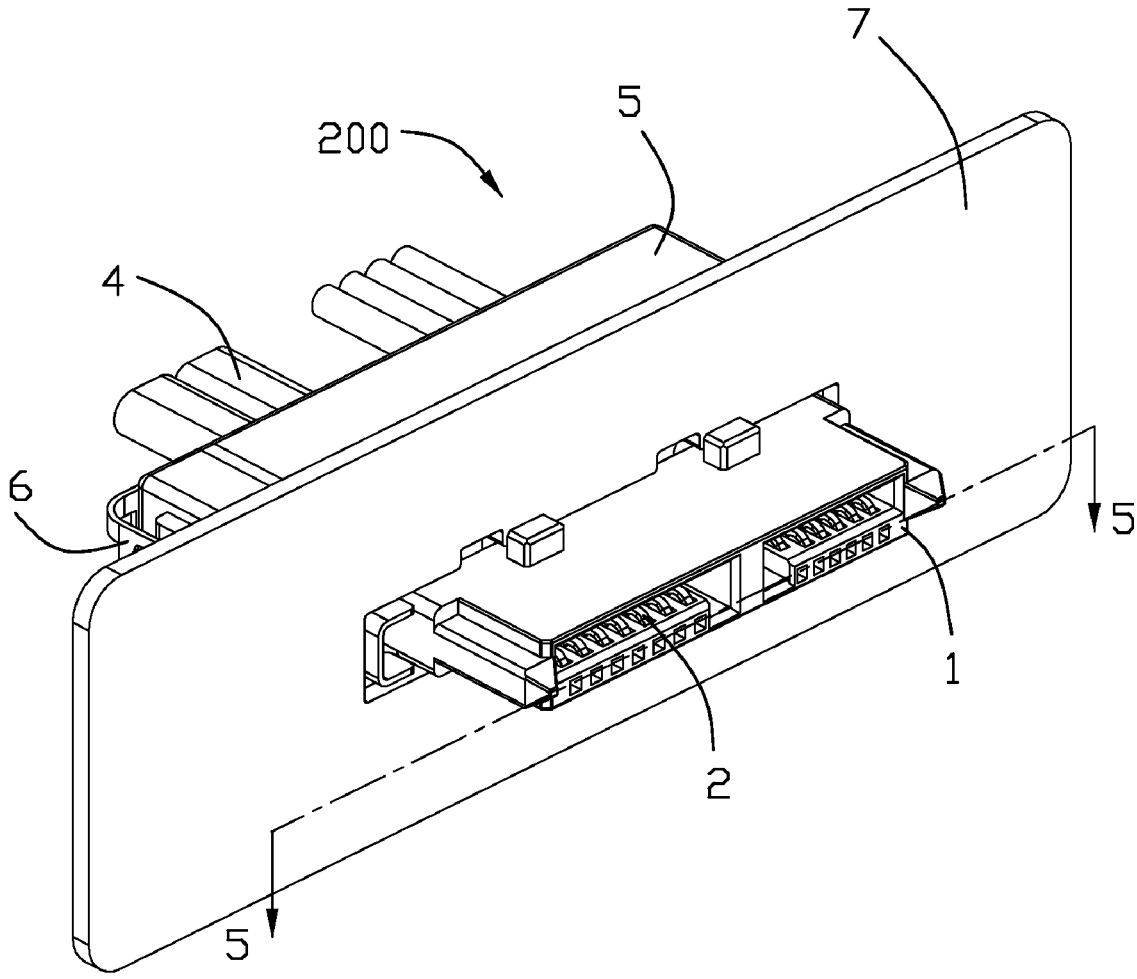
FIG. 1 is a perspective view of a cable assembly in accordance with the present invention mounted onto a panel.

Reference will now be made to the drawing figures to describe the present invention in detail.

Figure 2:
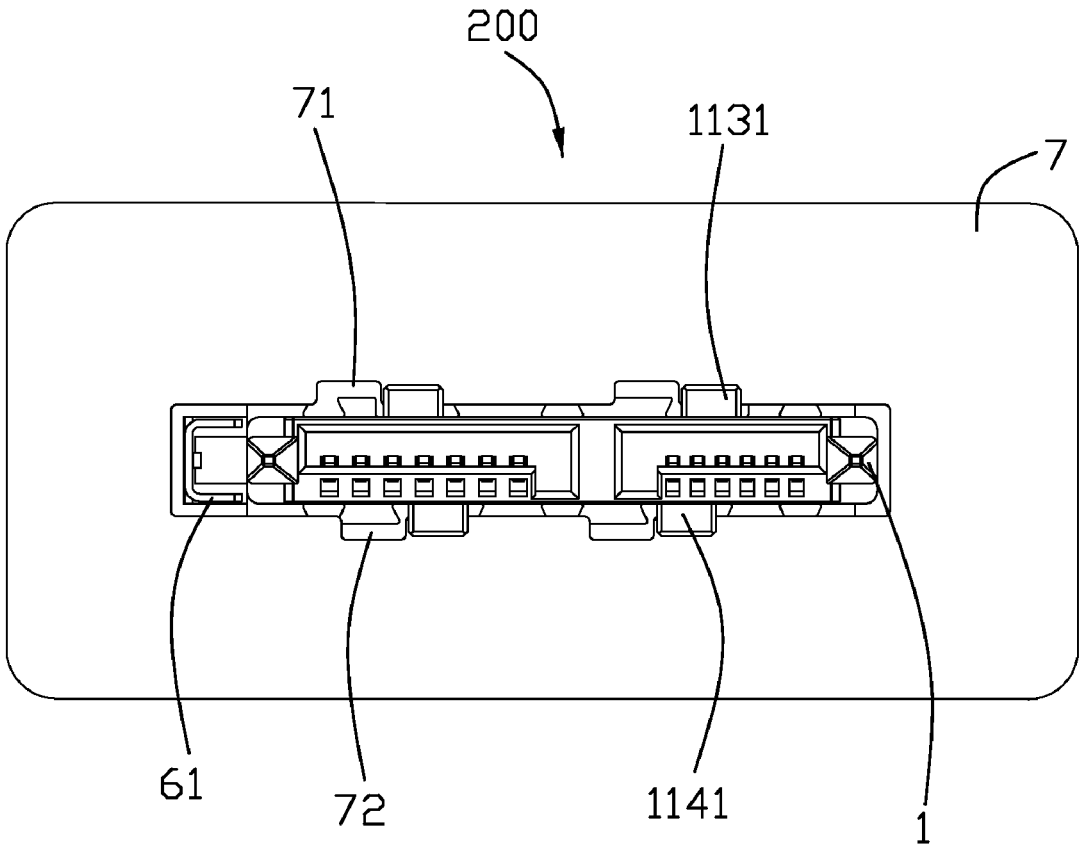
FIG. 2 is a front elevation view of FIG. 1.
Figure 3:
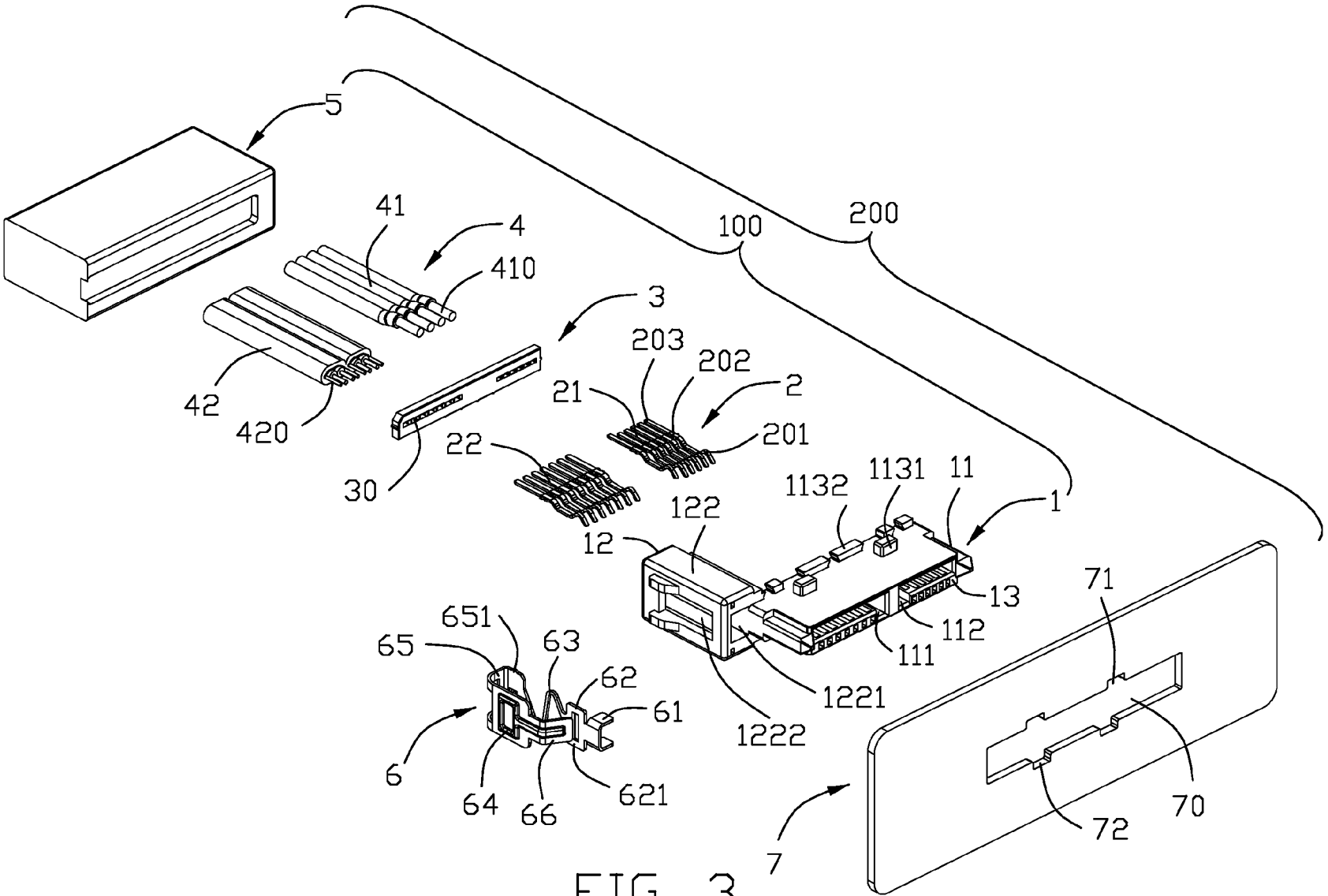
FIG. 3 is an exploded, perspective view of the cable assembly in accordance with the present invention and a panel.

Referring to FIGS. 1 to 3, a cable assembly 100 in accordance with the present invention, is adapted to be mounted onto a panel to form a floating panel mount system 200, comprises an insulative housing 1, a plurality of conductive contacts 2 assembled to the housing 1, a spacer 3 assembled to a rear end of the housing 1 and allowing rear ends of the plurality of conductive contacts 2 pass through, a plurality of cables 4 electrically connected with the conductive contacts 2 and a cover 5 assembled to the insulative housing 1. The cable assembly 100 further has a positioning member 6 assembled to the insulative housing 1.

Figure 4:
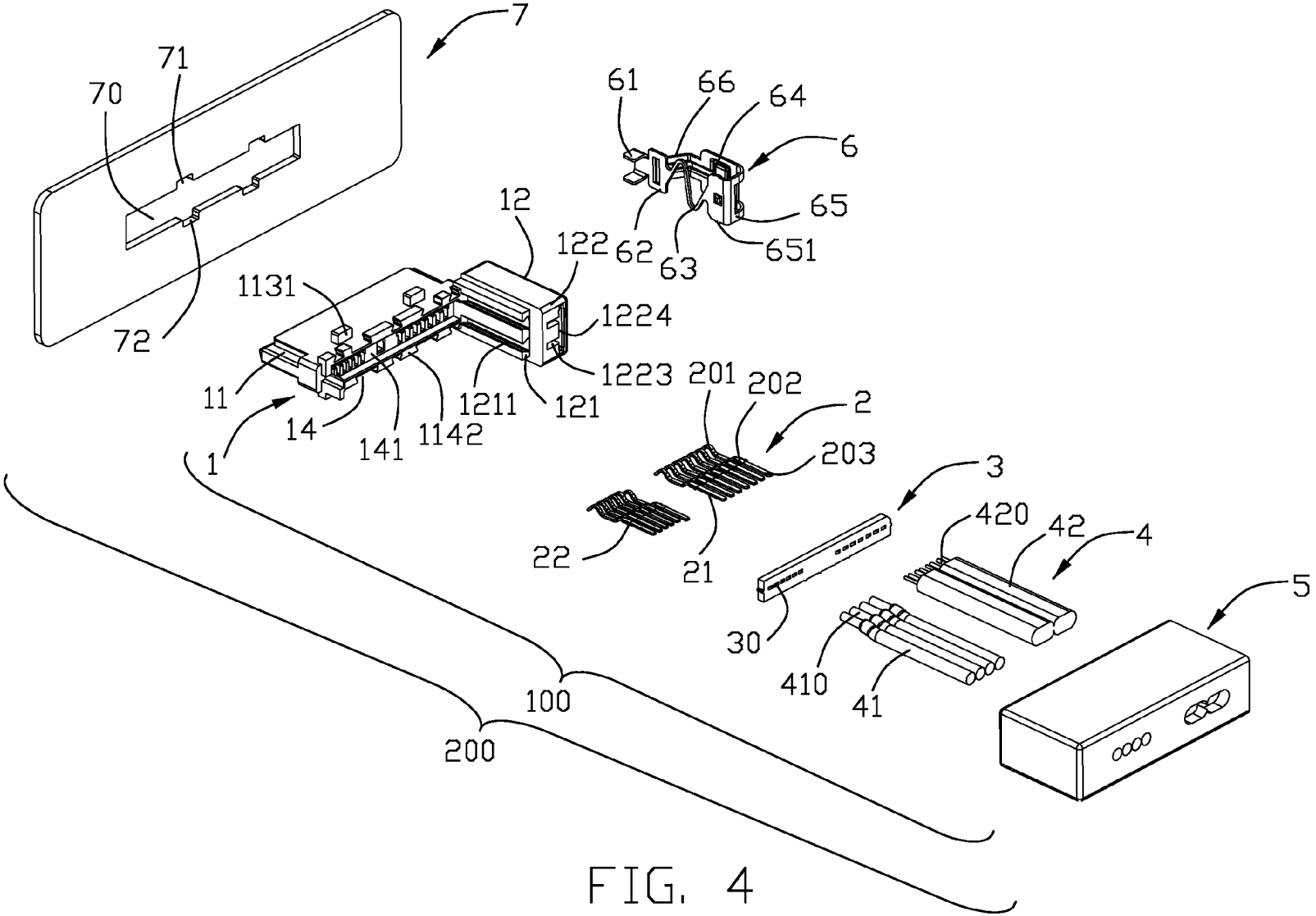
FIG. 4 is a view similar to FIG. 3, but taken from a different aspect.
Figure 5:
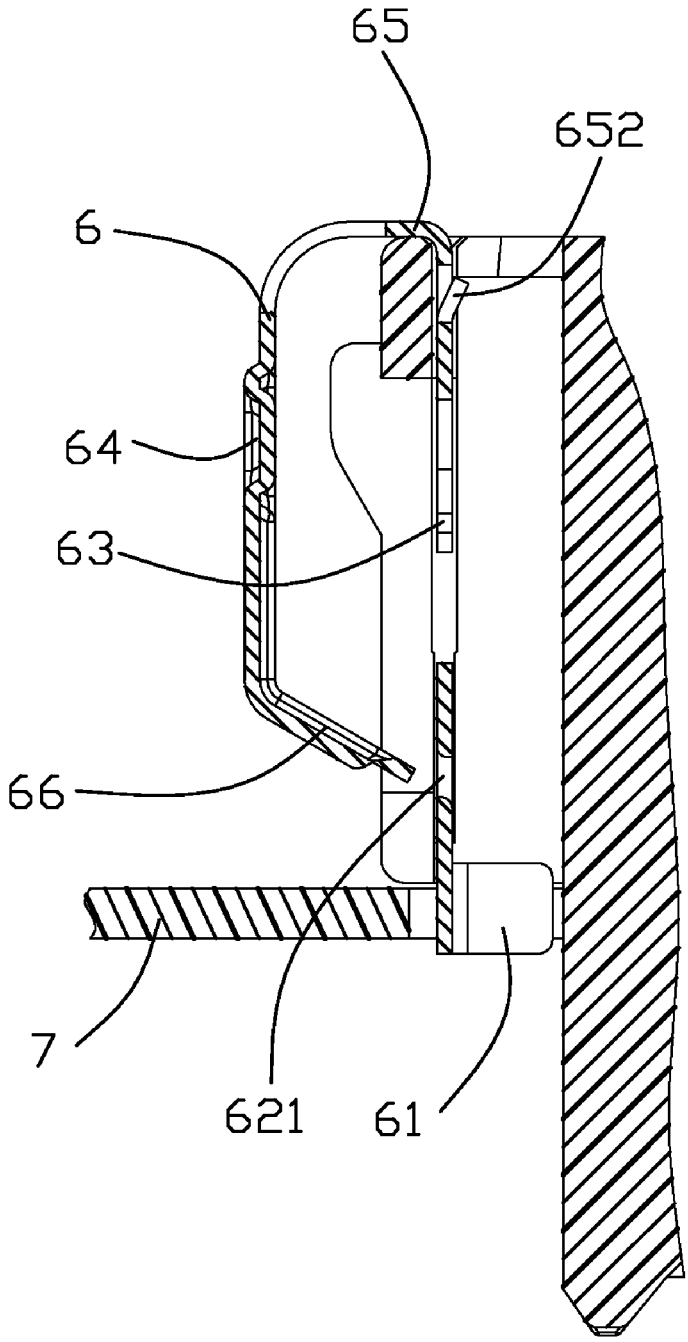
FIG. 5 is a partially cut away sectional view of FIG. 1 taken along line 5-5.
Figure 6:
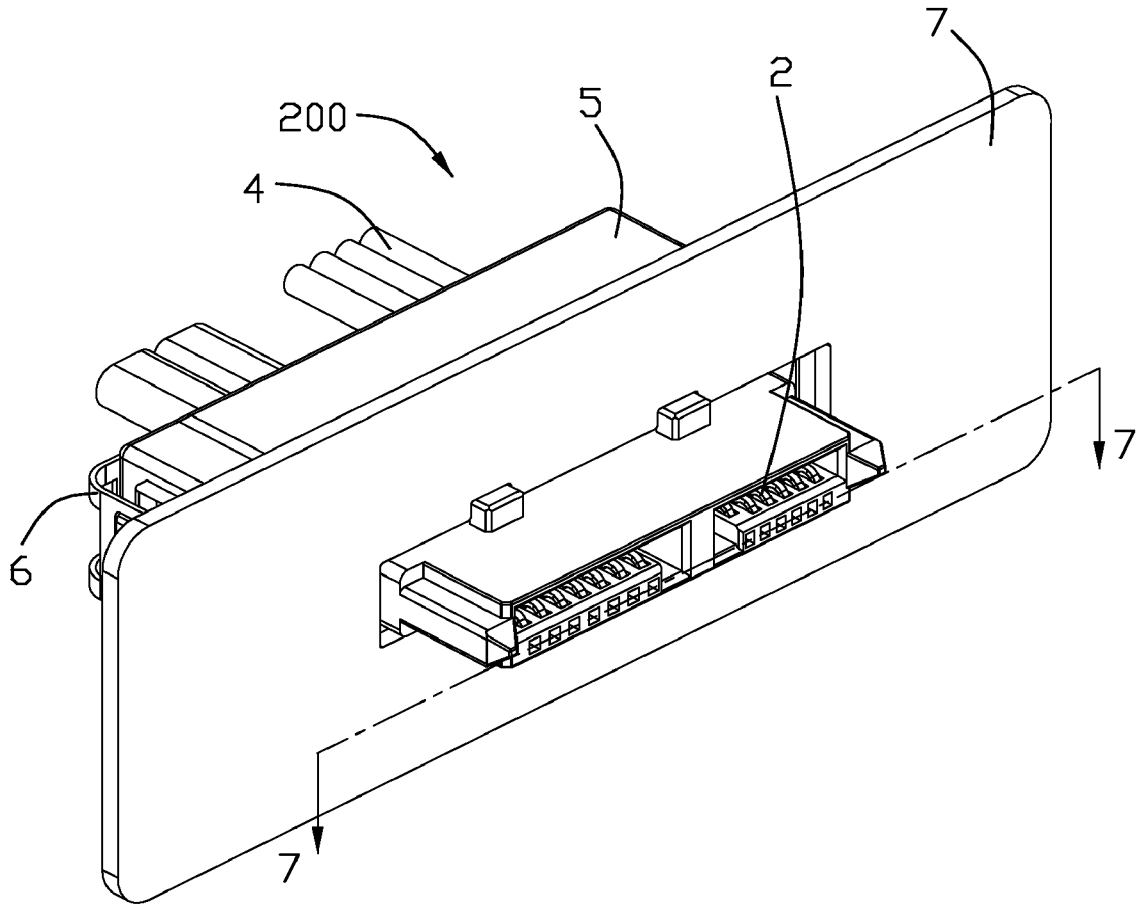
FIG. 6 is an assembled view of the cable assembly shown in FIG. 1 with a positioning member in FIG. 1 in a compressed state.
Figure 7:
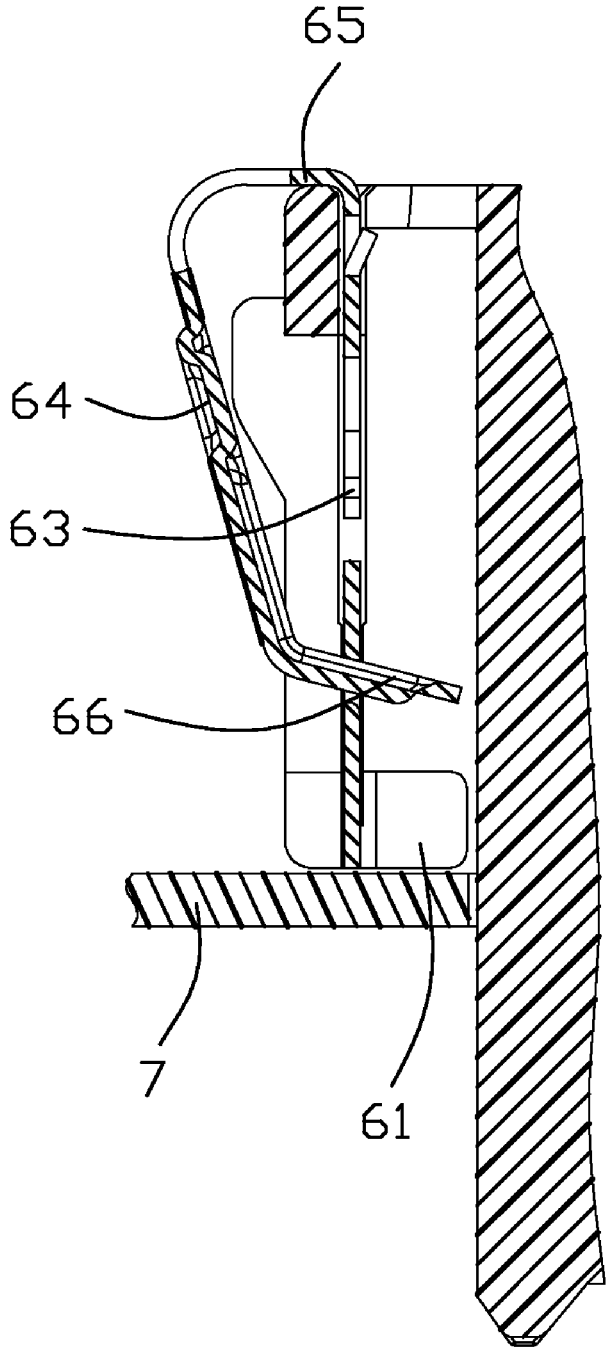
FIG. 7 is a partially cut away sectional view of FIG. 6 taken along line 7-7.
Figure 8:
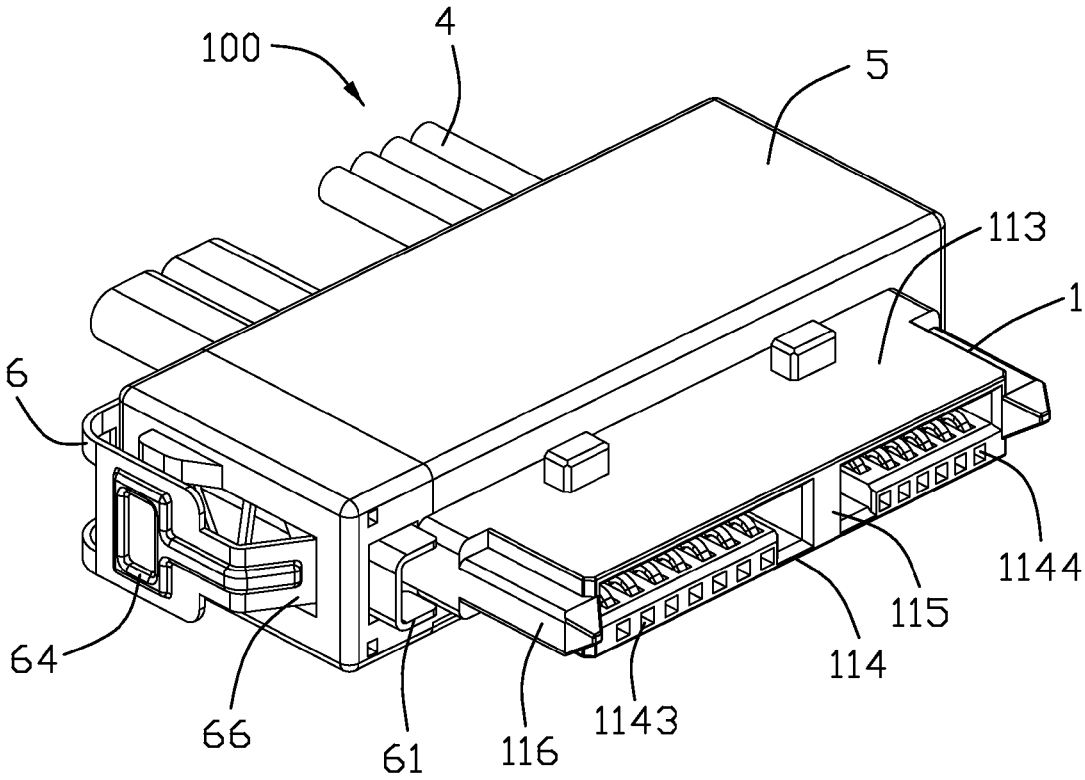
FIG. 8 is a perspective view of a cable assembly in accordance with the present invention.

Referring to FIGS. 3, 4 and 8, the insulative housing 1 is substantially elongated and comprises a mating portion 11 and a retaining portion 12 rearwardly and laterally extending from a rear end of the mating portion 11. The housing 1 comprises a mating face 13 at a front end of the mating portion 11 and a terminating face 14 opposite to the mating face 13. The insulative housing 1 defines a top wall 113, an opposite bottom wall 114 and a partition wall 115 extending between the upper wall 113 and the lower wall 114 in the mating direction and thus, defining two L-shaped receiving spaces 111, 112. A pair of first keys 1131 and a pair of second keys 1141 are respectively provided on outer surfaces of the top wall 113 and the lower wall 114, and a distance between the pair of the first keys 1131 is larger than that of the second keys 1141 for polarization. A pair of guiding projections 116 outwardly extend from opposite side surfaces (not labeled) of the mating portion 10 for guiding a proper insertion of a complementary connector (not shown). A plurality of protruding blocks 1132, 1142 are respectively formed on outer surface of the mating portion 10 and disposed in back of the first and second keys 1131, 1141. A receiving cavity 141 is formed on a terminating face 14 of the mating portion 11 for receiving the spacer 3. The bottom wall 114 corresponding to the two receiving spaces 111, 112 defines a plurality of first passages 1143 and a plurality of second passages 1144 extending to the terminating face 14 and communicated with the receiving cavity 141.

The retaining portion 12 of the insulative housing 1 is composed of a flat plate 121 essentially connecting with the mating portion 11 and a body portion 122 extending outwardly from the flat plate 121. The flat plate 121 defines a plurality of slots 1211 in an inner surface thereof for reliably securing to the cover 5 during overmolding the cover 5 with the insulative housing 1. The body portion 122 defines a receiving hole 1221 extending rearwardly from a front surface of the body portion 122. The body portion 122 is formed by a rear wall (not labeled), two opposite side walls (not labeled), a top wall (not labeled) and a bottom wall (not labeled). A cutout 1222 is formed on an outside wall and communicated with the receiving hole 1221. Two paralleled horizontal slots 1223 and a vertical slot 1224 are all formed on the rear wall of the retaining portion 12. The two horizontal slots 1223 are both communicated with the vertical slot 1224.

Referring to FIGS. 3 and 4, the plural contacts 2 are divided into a first set 21 and a second set 22. The first set 21 is composed of seven contacts 2 used for transmitting signal. The second set 22 is composed of six contacts 2 used for transmitting power. Each conductive contact 2 comprises a retention section 202, a mating section 201 extending forwardly from one end of the retention section 202, and a contacting section 203 extending rearwardly from the other end of the retention section 202.

Referring to FIGS. 3 and 4, each spacer 3 is elongated and is made of insulative material. A plurality of through-holes 30 are defined through the spacer 3 corresponding to the first and second passages 1143, 1144 and allows the contacting section 23 of each contact 2 pass through the spacer 3.

Referring to FIGS. 3 and 4, the cable 4 comprises a first cable 41 having a plurality of first conductors 410 therein and a second cable 42 having a plurality of conductor 420 therein. The first and second conductors 410, 420 can be electrically connected to the contacting sections 23 of the plurality of contacts 2.

Referring to FIGS. 3, 4 and 8, the cover 5 is surrounded to a rear end of the mating portion 11 of the insulative housing 1 and a front end of the cable 4 through an overmolding process and engages with an inner side of the retaining portion 12.

Referring to FIGS. 3 to 8, the positioning member 6 is formed of metallic material, it defines a U-shaped engaging portion 61, a action portion 62 extending rearwardly from the engaging portion 61, an elastic portion 63 extending rearwardly from the action portion 62, a pressing portion 64 paralleled with the elastic portion 63, a connecting portion 65 connecting with the elastic portion 63 and the pressing portion 64, and an inclined actuating portion 66 extending forwardly and inwardly from a front end of the pressing portion 64. The action portion 62 defines a slit 621 for cooperating with the actuating portion 66. The elastic portion 63 is wavy and in a strip-shaped. The connecting portion 65 defines a plurality of barbs 651 on opposite top and bottom sides thereof and a tab 652 for retaining the positioning member 6 to the insulative housing 1. The positioning member 6 is composed of an inner arm formed by the engaging portion 61, the action portion 62 and the elastic portion 63, a connecting portion 65 and an outer arm formed by the pressing portion 64 and the actuating portion 66.

Referring to FIGS. 2 to 4, the panel 7 is a rectangular board and defines a mounting opening 70 in a center thereof, and a pair of first and second fitting openings 71, 72 in communication with the mounting opening 70. The first and second fitting openings 71, 72 are respectively in alignment with the first and second keys 1131, 1141 of the insulative housing 1 in a front-to-back direction.

Referring to FIGS. 1 to 8, in assembly, the contacts 2 of the first set 21 and the second set 22 are respectively inserted into the first passages 1143 and the second passages 1144 with a front portion of mating sections 201 exposed into the two receiving spaces 111, 112. The retention sections 202 interferentially fit into corresponding passages 1143, 1144 for securing the conductive contacts 2 to the insulative housing 1. The contacting sections 203 of the contacts extends out of the rear end of the insulative housing 1. Then, the spacer 3 is received into the receiving cavity 141 of the insulative housing 1 with the contacting sections 203 of the contacts 2 passing through corresponding through-holes 30 thereof Then, the first and second conductors 410, 420 of the cable 4 are respectively electrically connected with the contacting sections 203 of the contacts 2 through soldering means. And, a cover 5 is covered to the rear end of the insulative housing 1 and a front end of the cable 4 through an overmolding process, and engaged with an inner side of the retaining portion 12.

Particularly referring to FIGS. 1, 5, 7 and 8, at last, the positioning member 6 is assembled to the retaining portion 12 of the insulative housing 1 along a rear-to-front direction. The engaging portion 61 passes through the two horizontal slots 1223 and a vertical slot 1224. The positioning member 6 is moved forwardly until the connecting section 65 abutting upon a rear surface of the retaining portion 12. At this time, the action portion 62 and the elastic portion 63 are disposed into the receiving hole 1221, a portion of the engaging portion 61 extending out of the receiving hole 1221. The pressing portion 64 is located on a lateral side of the retaining portion 12. A front end of the actuating portion 66 extends into the receiving hole via a cutout 1222 of the retaining portion 12. The connecting portion 65 of the positioning member 6 is engaged with the retaining portion 12 of the insulative housing 1.

Referring to FIGS. 1 to 8, when the cable assembly 100 is assembled to the panel 7, firstly, exerting an inward pressure on the pressing portion 64, thus, the front end of the actuating portion 66 is passed through the slit 621 of the action portion 62 and moved rearwardly. And the action portion 62 is moved rearwardly to make the elastic portion 63 compressed, and the engaging portion 61 is also moved rearwardly for a distance and retracted into the receiving hole 1221. At the same time, the mating portion 11 passes through the mounting opening 70 until a front surface of the cover 5 abuts against a rear side of the panel 7. The first and second keys 1131, 1141 respectively pass through corresponding first and second fitting openings 71, 72. The cable assembly 100 is then moved relative to the panel 7 in a widthwise direction until the first and second keys 1131, 1141 abutting against a front side of the panel 7. At this time, removing the pressure exerted on the pressing portion 64, thus, the actuating portion 66 is divorced from the action portion 62 to make the elastic portion 63 resumed to an original state. At this time, the engaging portion 61 is entered into one side of the mounting opening 70, thus, the cable assembly 100 is mounted onto the panel 7. The cable assembly 100 is positioned to the panel 7 in the longitudinal and widthwise direction. When the cable assembly 100 needs to be removed from the panel 7, exerting an inward pressure to the pressing portion 64 to make the actuating portion 66 moved inwardly and rearwardly to cooperate with the action portion 62. As a result, the action portion 62 is moved rearward due to a rearward force acting thereon. Thus, the engaging portion 61 of the positioning member 6 is moved out of the mounting opening 70 and retracted into the receiving hole 1221 as the action portion 62 moved rearward. After that, the cable assembly 100 can be removed from the panel 70 easily.

It should be noted that the cable assembly 100 is easily assembled and disassembled from the panel 7 due to the positioning member 6 easily entered into and exited of the mounting opening 70.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly for mounting to a panel, comprising:

a housing comprising a mating portion and a retaining portion extending rearward and outward from a rear end of the mating portion, the retaining portion having a receiving hole therein and a cutout defined in the retaining portion and communicated with the receiving hole, at least one key formed on each of an upper surface and a lower surface of the mating portion;

a plurality of conductive contacts disposed in the housing;

a positioning member attached to the retaining portion of the housing, the positioning member having an inner arm, an outer arm and a connecting portion connecting with the inner arm and the outer arm, the inner arm disposed in the receiving hole and having a front end extending out of the receiving hole, the outer arm located on a lateral side of the retaining portion and having a front end extending into the receiving hole via the cutout and capable of moving the inner arm rearward to make the front end of the inner arm retracted into the receiving hole.

2. The cable assembly as recited in claim 1, wherein the inner arm comprises an engaging portion formed on at front end thereof, an elastic portion and a action portion connected with the engaging portion and the elastic portion.

3. The cable assembly as recited in claim 2, wherein the out arm comprises a pressing portion and an inclined actuating portion, the front end of the outer arm is formed on a free end of the inclined actuating portion.

4. The cable assembly as recited in claim 1, wherein the retaining portion comprises a flat plate connecting with the mating portion and a body portion extending outwardly from the flat plate, the receiving hole disposed in the body portion.

5. The cable assembly as recited in claim 4, wherein the cable assembly further comprises a cable electrically connected with the conductive contacts and a cover surrounded to a rear end of the mating portion of the housing and a front end of the cable, and engaged with an inner side of the retaining portion.

6. The cable assembly as recited in claim 1, wherein the plurality of contacts are divided into a first set and a second set, the first set is composed of seven contacts used for transmitting signal, the second set is composed of six contacts used for transmitting power.

7. The cable assembly as recited in claim 1, wherein each conductive contact comprises a retention section, a mating section extending forwardly from one end of the retention section, and a contacting section extending rearwardly from the other end of the retention section.

8. The cable assembly as recited in claim 7, wherein a spacer attached to a rear surface of the housing defines a plurality of openings allowing the contacting sections of the contacts pass through the spacer.

9. The cable assembly as recited in claim 3, wherein the action portion of the inner wall defines a slit for cooperating with the front end of actuating portion of the outer wall.

10. The cable assembly as recited in claim 1, wherein the at least one key comprises a pair of first keys on an upper surface and a pair of second keys on an lower surface of the housing, and a distance between the pair of first keys is larger than that of the second keys.

11. A cable assembly adapted to be mounted to a panel having a mounting opening, comprising:

a connector having a mating portion and at least a key formed on each of an upper surface and a lower surface of the mating portion, said connector mounted to the panel, with the mating portion passed through the mounting opening of the panel from one side to another side along a longitudinal direction and engaged with the panel after a movement of the mating portion relative to the panel along a transversal direction perpendicular to the first direction;

a retaining member connected to a lateral side of the connector and disposed rearward of the panel, said retaining member having a receiving hole and a cutout communicated with each other therein;

a positioning member mounted to the retainer member, having an elastic inner arm received into the receiving hole and with an engaging portion extending out of the receiving hole for being received into the mounting opening, and an outer arm with an inclined actuating portion extending into the receiving hole via the cutout, while an inward pressure exerted on the outer wall, the inclined actuating portion actuating the elastic inner arm compressed and fully retracted into the receiving hole such that the mating portion is capable of exiting from the opening of the panel.

12. The cable assembly as recited in claim 11, wherein the positioning member further defines a connecting portion connected with the elastic inner arm and the outer arm.

13. The cable assembly as recited in claim 12, wherein the elastic inner arm further defines a action portion extending rearward form the engaging portion and cooperated with the actuating portion and an elastic portion extending rearward from the action portion.

14. The cable assembly as recited in claim 13, wherein the outer arm further defines a pressing portion disposed between the connecting portion and the actuating portion, and paralleled with the inner arm.

15. The cable assembly as recited in claim 11, wherein the positioning member is formed of metallic material.

16. The cable assembly as recited in claim 13, wherein the elastic portion is wavy and in a strip-shaped.

17. A cable connector assembly comprising:

an insulative housing defining an elongated mating portion and a retaining portion at one end of said mating port along a lengthwise direction of the housing;

a plurality of contacts disposed in the housing with contacting sections extending into the mating port;

a plurality of wires connected to rear sections of the corresponding contacts, respectively;

a positioning member located in the retaining portion and including an engaging portion normally extending from an elastic portion via an action portion, and forward beyond the retaining portion while being retractable in a front-to-back direction perpendicular to said lengthwise direction, and a pressing portion located beside said engaging portion and moveable in said lengthwise direction toward the elastic portion to engage the action portion for urging said action portion and said engagement portion to move rearwardly in said front-to-back direction.

18. The cable connector assembly as claimed in claim 17, wherein said positioning member is of a one piece unitarily.

19. The cable connector assembly as claimed in claim 17, wherein said pressing portion includes an inclined actuating portion to act upon said action portion so as to urge said action portion to move rearwardly.

20. The cable connector assembly as claimed in claim 17, wherein said pressing portion intersects with said action portion.

* * * * *